United States Patent [19]

Bauer et al.

[11] Patent Number: 5,040,530

[45] Date of Patent: Aug. 20, 1991

[54] BREATHING MASK WITH CUFF BAND

[75] Inventors: Christoph Bauer, Bad Schwartau; Rudolf Greiff, Badendorf; Wolfgang Marquardt, Stockelsdorf; Holmer Röhling, Reinfeld, all of Fed. Rep. of Germany

[73] Assignee: Drägerwerk Aktiengessellschaft, Lubeck, Fed. Rep. of Germany

[21] Appl. No.: 543,336

[22] Filed: Jun. 25, 1990

[30] Foreign Application Priority Data

Jun. 30, 1989 [DE] Fed. Rep. of Germany ..... 3921603

[51] Int. Cl.[5] ..... A62B 23/00

[52] U.S. Cl. ..... 128/206.12; 128/201.25; 2/7

[58] Field of Search ..... 128/206.12, 206.28, 128/207.11, 205.27, 206.14, 206.17, 206.21, 201.22, 201.25, 201.23, 205.25, 201.12, 201.14, 201.15, 201.16, 201.17, 201.24, 206.19, 206.22, 206.23, 206.24, 206.25, 206.26; 2/206, 5, 7, 6, 9, 10

[56] References Cited

U.S. PATENT DOCUMENTS

| | | | |
|---|---|---|---|
| 3,227,159 | 1/1966 | Borgia et al. | 128/201.15 |
| 4,473,072 | 9/1984 | Walther | 128/201.25 |
| 4,520,509 | 6/1985 | Ward | 128/206.17 |
| 4,811,728 | 3/1989 | Von Kopp | 128/201.25 |

*Primary Examiner*—Edgar S. Burr
*Assistant Examiner*—Stephen R. Funk
*Attorney, Agent, or Firm*—McGlew & Tuttle

[57] ABSTRACT

A breathing mask with a half mask and a nape band is to be improved such that secure contact of the mask in the entire nose and mouth region of the mask user is ensured by the nape band. The mask is thus effectively prevented from slipping despite the fact that the band is located in the nape region only. An additional application of a hood is possible without providing additional holding members. To accomplish this task, the band can be applied in the form of a rubber-elastic cuff (5) which has a neck opening (6) and a head opening (7). The mask and cuff are preferably made in one piece of silicone rubber, and the hood can additionally be bonded to the cuff.

8 Claims, 2 Drawing Sheets

BREATHING MASK WITH CUFF BAND

FIELD AND BACKGROUND OF THE INVENTION

The present invention pertains in general to a breathing mask to which a respirator filter can be connected, and in particular to a mask with a band which extends from the mask user's nape region to a half mask-like body which has a sealing lip at least around the region of the bridge of the nose and the chin.

Such a breathing mask has become known from U.S. Pat. No. 1,410,928.

The prior-art breathing mask is held as a half mask around the nose and mouth region of the mask user by a nape band and is held against the mask user's face via a sealing lip surrounding the edge of the mask. Undesirable solids on the outside are kept away from the inside of the mask by a filter. An additional hood is pulled over the half mask, leaving the filter free, and it is also held by the nape band when it is put on. The hood drops as an apron in the shoulder zone of the mask user.

One disadvantage of the prior-art breathing mask is that the narrow nape band has only one point of attachment on each side of the mask body in order to pull the sealing lip of the half mask firmly against the face. The half mask may easily slip in the case of different head shapes, especially in the nuchal region, and during the use of the breathing mask under difficult conditions. Firm seating is not guaranteed. The adhesive and hence sealing properties of the half mask are further impaired by sweating in the region of the mask. The punctiform introduction of force into the mask makes it necessary to design the body of the mask as a rigid body, which makes adaptation to different shapes of face difficult. If, in addition, a hood is pulled over the head, the nape band is also pulled over the protective hood, and its adhesive contact with the surface of the mask user's head is further impaired. Moreover, additional sealing measures are required in order to prevent harmful substances from penetrating into the inside of the hood under and through the hood apron hanging only loosely on the shoulders.

SUMMARY AND OBJECTS OF THE INVENTION

It is an object of the present invention to improve a breathing mask of the class specified such that secure contact of the mask in the entire nose and mouth region of the mask user is ensured by nape bands, and the mask is effectively prevented from slipping despite the fact that the bands are located in the nuchal region only. The additional application of a hood shall be possible without the use of further sealing devices.

This task is accomplished so that the bands, in the form of an elastic cuff, can be placed around the cheek and nape region of the mask user. The cuff is connected to the mask body along the edge of the mask that may form a continuous band having a neck opening that is in sealing contact around the neck of the mask user. There is an opening for the head of the mask user, which carries a sealing bead originating from the region around the bridge of the nose of the mask and surrounds the opening at least partially.

The advantage of the present invention is essentially the fact that the adhesive friction is increased and nonslip seating is made possible by the broad contact surface of the cuff in the region of the cheek and nape. In addition, the force is introduced by the head band along a line rather than at a point, and thus makes it possible to design the mask as a more flexible mask. This makes better adaptation to different face shapes possible. The sealing edge for the breathing mask is now additionally displaced to the neck region of the mask user, on one hand, and to the line connecting the bridge of the nose to the nape of the mask user, on the other hand. Contrary to the state of the art, these sealing edges extend mainly in the horizontal direction. This prevents the mask from slipping under the effect of jarring or under the effect of gravity alone if the adhesive friction of the mask is reduced by sweating.

Improvement of the nonslip holding of the mask is achieved by making the mask and the cuff in one piece from silicone rubber. A sealing lip at the lateral edge of the half mask can now be abandoned altogether, because the sealing function in this region is now taken over by the cuff. In addition, sealing is ensured in the lower zone of the mask via the neck opening. The sealing effects of both seals are easier to manage because of their flat contours. Prior-art masks, whose lips are in contact around nose and mouth regions, characterized by cavities and projecting shapes of the face are difficult to seal.

The breathing mask does not need to be modified, and its sealing properties remain the same when an at least partially transparent hood made of a flameproof and heat-resistant material is attached airtightly to the edge of the head opening. The head opening can serve as an adhesive edge for applying the hood. Unfiltered ambient air is effectively prevented from penetrating into the hood zone by the cuff shape of the nape band.

It may be useful to provide the cuff in the nape region with a strap that is in contact with the occipital region of the mask user. When the mask or the hood is put on with the sides mistakenly switched by the mask user, the user is immediately warned of this error, because the strap now appears before his eyes and his field of vision is markedly narrowed or even completely obstructed. Such errors in use may occur especially when the hood or the mask is put on by persons not familiar with the use of the mask under difficult conditions such as in the case of danger.

Further improvement of the present invention is achieved by providing the hood with a barrier layer that is impermeable to water vapor. Such a barrier layer may be, e.g., an aluminized polyethylene film, of which the hood is made, and which leaves open a transparent zone at the level of the eyes. Thus, the hood can also serve as a packaging film at the same time, which contains essentially the filter and the mask and surrounds them in a vacuum-tight manner. In the packaged state, the hood protects filter materials that are sensitive to water vapor and are present in the respirator filter. A pull-off strip is provided, which is removed to open the package and exposes the cuff, through which the head of the mask user passes, and the hood is pulled over the head.

A further object of the invention is to provide a breathing mask which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
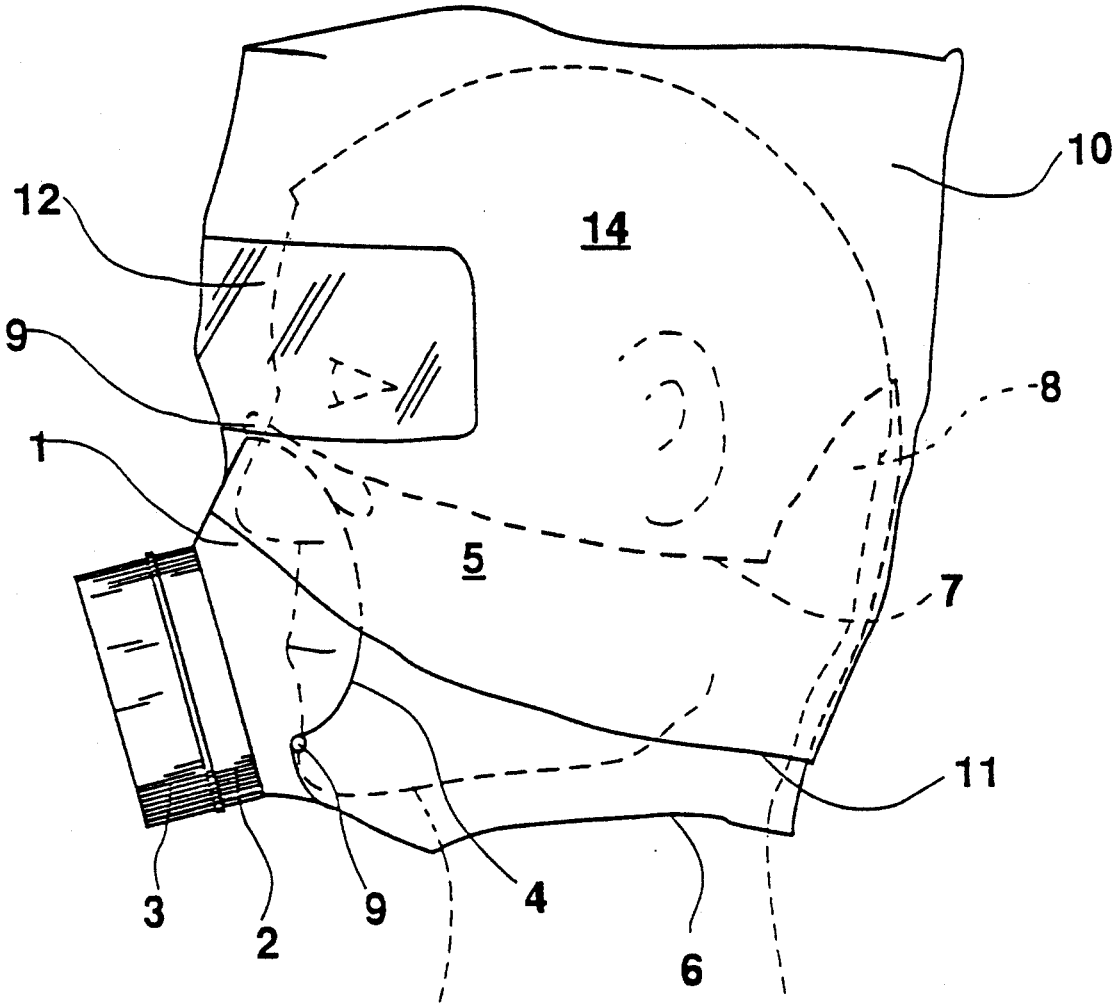
FIG. 1 is a breathing mask with a hood belonging to it.

FIG. 1 shows a breathing mask 1 as a half mask lying over the nose and mouth region of the mask user. The breathing opening is connected to a respirator filter 3 via a tie-in connection 2. The respirator filter 3 may contain a CO filter insert and a particle filter preceding it (both are not shown). The mask edge 4 that is in contact with the face is provided with a one piece nape band designed as a cuff forming a continuous loop for surrounding the head. The band comes to lie around the nape of the mask user beginning from the mask 1 and is in tight contact with the nose, cheek region and the nape because of its elasticity. The cuff 5 terminates under the chin region and has a neck opening 6 that closely fits the neck of the mask user. An opening 7 for the head of the mask user is in a sealing contact with the outer face contour of the mask user and surrounds the ridge of the nose, cheek and nape region of the head. At the rear end of the head opening 7, the edge of the head opening is extended in the form of a strap 8 which extends into the occipital region of the mask user. In the chin region and in the region of the side of the nose, the half mask 1 has reinforcements 9 which are also designed as sealing lips because of their bead-shaped design. A hood 10 made of heat-resistant and fireproof material is bonded to the cuff 5 along the dash-dotted line Said hood 10 is provided with an aluminum backing 14 serving as a barrier layer, which leaves a window 12 open in the region of the eyes of the mask user.

Figure 2:
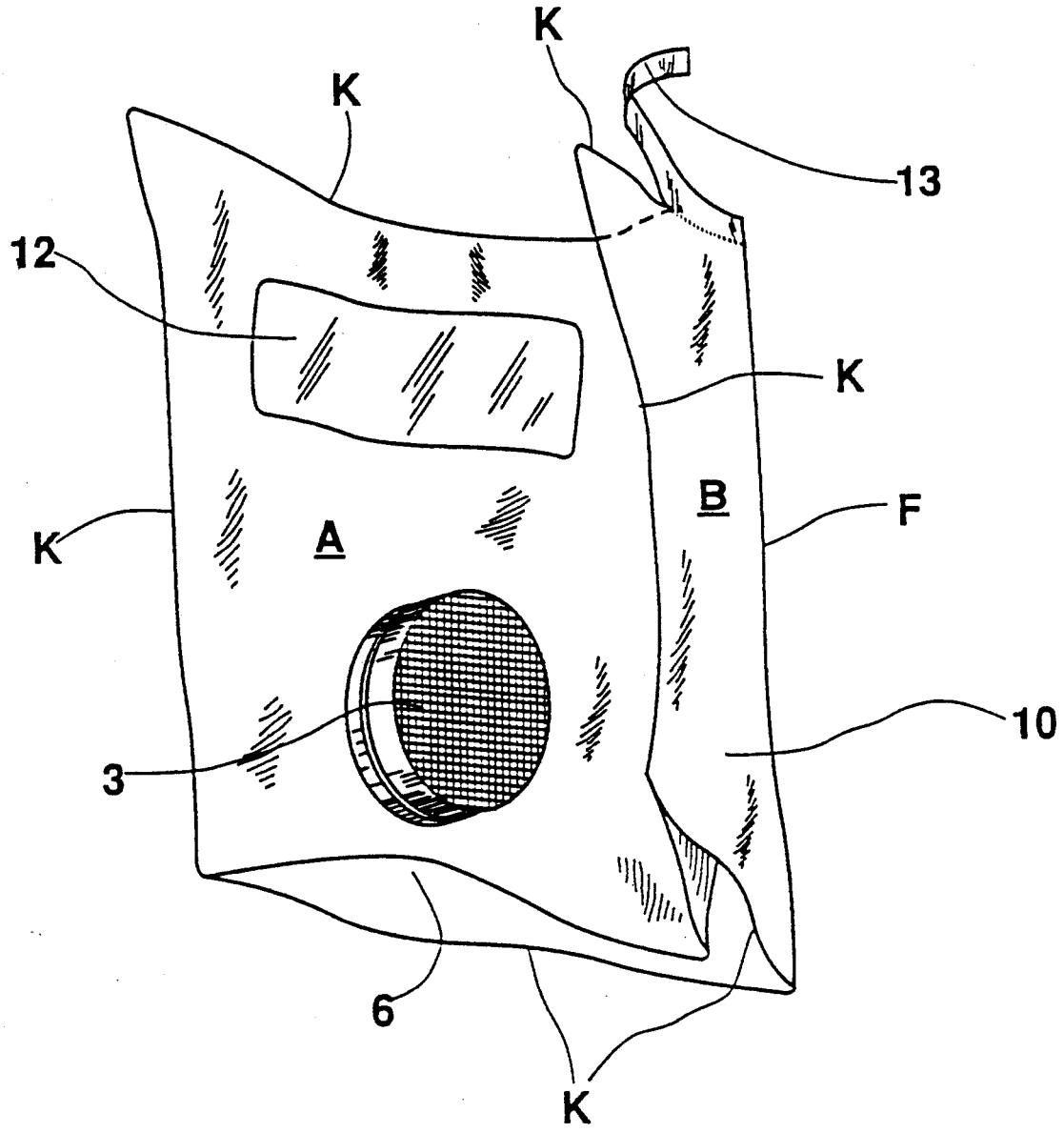
FIG. 2 shows the folded breathing mask and hood after the opening of the package.

FIG. 2 shows a folded hood 10 which may be folded in one manner by lying the hood on its back on a flat surface. The hood is replaced so that the window 12 and the respirator filter 3 are on the farthest left top side A of the hood as shown in FIG. 2. The remaining sections of the hood B are laid out on the right. The hood is then folded so that the left side A containing the window and respirator are covered by the aluminized folded half B of said hood 10, which is impermeable to water vapor. The hood contour K sealed by a pull-off strip 13 in the storage state provides for packaging that is impermeable to water vapor, and the neck opening 6 is also closed by the covering folded half B. To put on said hood 10, said pull-off strip 13 is torn off along the hood contour K, as a result of which the sealing is broken and the hood parts A and B can be unfolded. At the same time, said neck opening 6 is exposed, so that said hood 10 can be pulled over the head. Said pull-off strip 13 can either be torn off completely from said hood 10, or remain attached at one of the ends of the fold line F.

While a specific embodiment of the invention has been shown and described in detail to illustrate the application of the principles of the invention, it will be understood that the invention may be embodied otherwise without departing from such principles.

What is claimed is:

1. A breathing apparatus to be worn around the head and neck of a user allowing the user to breathe uncontaminated air, the apparatus comprising:

a half mask covering the nose and mouth of a user, said half mask having mask edges which come into contact with the face of the user;

a connection opening formed in said half mask to allow the uncontaminated air into said half mask and to be breathed by the user;

a wide cuff elastic band connected to said half mask, said elastic cuff band for positioning around the cheeks and nape of the users head, said wide cuff band being connected along the entire length of said mask edges to provide a head opening and a neck opening for the user, said neck opening forming a sealing contact with the neck of the user when worn;

a sealing lip on said head opening contacting at least a portion of the head, and forming a sealing contact with the head; and an at least partially transparent hood and means to air tightly attach said hood to said head opening.

2. An apparatus in accordance with claim 1, wherein: said partially transparent hood is made of flame proof and heat resistant materials.

3. An apparatus in accordance with claim 1, wherein: said partially transparent hood is provided with a barrier layer that is impermeable to water vapor.

4. An apparatus in accordance with claim 3, wherein: a filter is connected to said connection on said mask; said partially transparent hood is used as a vacuum tight packaging envelope for said half mask and said filter.

5. An apparatus in accordance with claim 4, wherein: said packaging envelope in sealed with a pulloff strip.

6. A breathing apparatus to be worn around the head and neck of a user allowing the user to breathe uncontaminated air, the apparatus comprising:

a half mask covering the nose and mouth of a user, said half mask having mask edges which come into contact with the face of the user;

a connection opening formed in said half mask to allow the uncontaminated air into said half mask and to be breathed by the user;

a wide cuff elastic band connected to said half mask forming a continuous loop, said elastic cuff band for positioning around the cheeks and nape of the users head, said wide cuff band being connected along the entire length of said mask edges to provide said continuous loop with a head opening and a neck opening for the user, said neck opening forming a sealing contact with the neck of the user when worn;

a sealing lip on said head opening contacting at least a portion of the head, and forming a sealing contact with the head; and an at least partially transparent hood and means to air tightly attach said hood to said head opening.

7. An apparatus in accordance with claim 6 wherein: said half mask and said wide cuff are made in one piece.

8. An apparatus in accordance with claim 6 wherein: said wide band cuff has a strap that is in contact with the occipital region of the mask user.

* * * * *